US010585365B2

(12) United States Patent
Sakimura et al.

(10) Patent No.: US 10,585,365 B2
(45) Date of Patent: Mar. 10, 2020

(54) IMAGE BEARING MEMBER FOR ELECTROPHOTOGRAPHY

(71) Applicant: Konica Minolta, Inc., Tokyo (JP)

(72) Inventors: Tomoko Sakimura, Tokyo (JP); Hiroki Takao, Tokyo (JP); Mayuko Matsusaki, Tokyo (JP); Kengo Ikeda, Saitama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/261,800

(22) Filed: Jan. 30, 2019

(65) Prior Publication Data

US 2019/0243261 A1 Aug. 8, 2019

(30) Foreign Application Priority Data

Feb. 8, 2018 (JP) ..... 2018-021063

(51) Int. Cl.

| | |
|---|---|
| ***G03G 5/147*** | (2006.01) |
| ***G03G 15/16*** | (2006.01) |
| ***G03G 5/10*** | (2006.01) |
| ***G03G 5/05*** | (2006.01) |

(52) U.S. Cl.

CPC ..... *G03G 5/14704* (2013.01); *G03G 5/0542* (2013.01); *G03G 5/0564* (2013.01); *G03G 5/102* (2013.01); *G03G 5/14708* (2013.01); *G03G 5/14717* (2013.01); *G03G 5/14734* (2013.01); *G03G 5/14773* (2013.01); *G03G 5/14786* (2013.01); *G03G 15/162* (2013.01); *G03G 2215/00957* (2013.01)

(58) Field of Classification Search

CPC ..... G03G 5/14704; G03G 5/14708; G03G 5/14717; G03G 5/14734; G03G 5/14773; G03G 5/14786; G03G 15/162

See application file for complete search history.

(56) References Cited

U.S. PATENT DOCUMENTS

| | | | | |
|---|---|---|---|---|
| 9,696,642 | B2 * | 7/2017 | Adachi | G03G 5/14791 |
| 2017/0219943 | A1 * | 8/2017 | Shibata | G03G 5/043 |

FOREIGN PATENT DOCUMENTS

| | | | |
|---|---|---|---|
| JP | H05-265244 | A | 10/1993 |
| JP | 2011-154067 | A | 8/2011 |

* cited by examiner

*Primary Examiner* — Janis L Dote

(74) *Attorney, Agent, or Firm* — Lucas & Mercanti, LLP

(57) ABSTRACT

An object of the present invention is to provide an image bearing member for electrophotography. The image bearing member has high mechanical properties which include abrasion resistance and scratch resistance, is excellent in toner releasability, and is capable of retaining these features. The present invention provides an image bearing member for electrophotography, which includes a surface layer, the surface layer being composed of a polymerization-cured product of a composition containing a polymerizable monomer and surface-treated metal oxide particles, and the surface-treated metal oxide particles are metal oxide particles surface-treated with a surface treating agent having a silicone side chain.

4 Claims, 1 Drawing Sheet

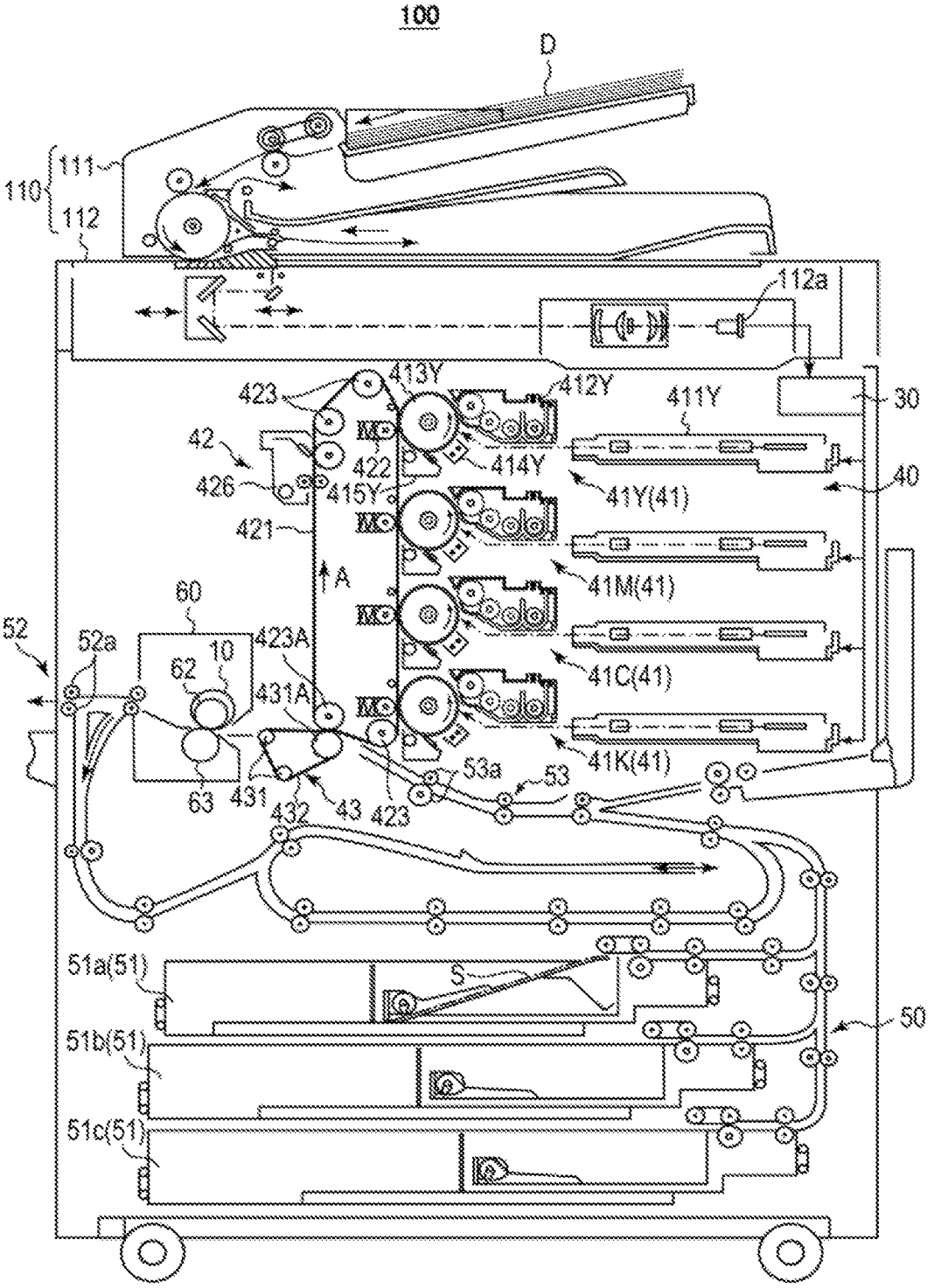
100
D
110
111
112
112a
30
40
413Y
412Y
411Y
423
42
422
414Y
426
415Y
41Y(41)
421
A
41M(41)
60
52
52a
10
62
423A
41C(41)
431A
41K(41)
53a
53
63
431
432
43
423
51a(51)
S
50
51b(51)
51c(51)

IMAGE BEARING MEMBER FOR ELECTROPHOTOGRAPHY

CROSS REFERENCE TO RELATED APPLICATIONS

Japanese Patent Application No. 2018-021063 filed on Feb. 8, 2018, including description, claims, drawing, and abstract the entire disclosure is incorporated herein by reference in its entirety.

BACKGROUND

Technological Field

The present invention relates to an image bearing member for electrophotography.

Description of Related Art

Recent increase of requirements for images of high resolution and high quality has brought use of a toner with small particle size for an electrophotographic image forming apparatus to the mainstream. A toner with small particle size has high adhesion to the surface of an image bearing member for electrophotography, such as a photoconductor and intermediate transfer member in the image forming apparatus. Thus, the image forming apparatus is likely to suffer from insufficient removal of a remaining toner such as an untransferred residual toner attaching to the surface of the image bearing member. In the case of an image forming apparatus employing a cleaning method with a rubber blade, for example, toner slipping is likely to occur. To prevent such toner slipping, it is required to increase the contact pressure of the rubber blade to the image bearing member. As the contact pressure becomes higher, however, the durability of the image bearing member tends to be lowered because of abrasion of the surface of the image bearing member through repeated use.

To lower the adhesion of an image bearing member to a toner and thereby improve the cleanability, it has been proposed to add a fluorine-containing material such as a fluorine-containing fine particle and a fluorine-containing lubricant to the surface layer of an image bearing member. However, increasing such fluorine-containing materials tends to degrade the surface hardness, resulting in degradation of the mechanical properties including abrasion resistance and scratch resistance. In addition, the fluorine-containing material is highly surface-oriented and thus tends to be present in the vicinity of the surface of an image bearing member at a high concentration. As a result, the lubricity of such an image bearing member is likely to be lowered to give an insufficient effect when the surface is worn away through repeated use, although the image bearing member keeps high lubricity in a short period after initiation of use.

As a technique for enhancing both of the abrasion resistance and cleanability of an image bearing member, a method of providing the surface of an image bearing member with a layer containing a surface-treated metal oxide fine particle has been proposed. For example, Japanese Patent Application Laid-Open No. H05-265244 discloses an electrophotographic photoconductor including a protective layer containing a conductive particle surface-treated with methyl hydrogen silicone oil. Japanese Patent Application Laid-Open No. 2011-154067 discloses an organic photoconductor for development of electrostatic latent images, the organic photoconductor provided with a protective layer containing a reaction product of a metal oxide fine particle surface-treated with a surface treating agent having a reactive organic group and silicone oil.

Studies by the present inventors found that the image bearing members including a protective layer containing a surface-treated metal oxide fine particle (conductive particle) disclosed in Japanese Patent Applications Laid-Open No. H05-265244 and No. 2011-154067 keep good cleanability in initial stages but lose the cleanability in some cases to an insufficient level after a durability test. Thus, conventional image bearing members still need to be studied from the viewpoint of achieving abrasion resistance and retention of high cleanability in combination.

SUMMARY

An object of the present invention is to provide an image bearing member for electrophotography, the image bearing member having high mechanical properties including abrasion resistance and scratch resistance, being excellent in toner releasability, and being capable of retaining these features.

To achieve at least one of the abovementioned objects, according to an aspect of the present invention, an image bearing member for electrophotography, reflecting one aspect of the present invention comprises a surface layer, wherein the surface layer is composed of a polymerization-cured product of a composition comprising a polymerizable monomer and surface-treated metal oxide particles, the surface-treated metal oxide particles being surface-treated with a surface treating agent having a silicone side chain.

BRIEF DESCRIPTION OF DRAWING

The advantages and features provided by one or more embodiments of the invention will become more fully understood from the detailed description given hereinbelow and the appended drawing which are given by way of illustration only, and thus are not intended as a definition of the limits of the present invention.

FIG. 1 is a schematic illustrating one example of configurations of an image forming apparatus for which an image bearing member according to one embodiment of the present invention is used.

DETAILED DESCRIPTION OF EMBODIMENTS

Hereinafter, one or more embodiments of the present invention will be described. However, the scope of the invention is not limited to the disclosed embodiments.

The image bearing member according to the present embodiment is an image bearing member for electrophotography and includes a surface layer.

An image bearing member for electrophotography refers to an object to bear a latent image or visualized image on its surface in an electrophotographic image forming method. Examples of such image bearing members include electrophotographic photoconductors and intermediate transfer members (e.g., intermediate transfer belts and intermediate transfer drums).

The image bearing member has the same configuration as conventional image bearing members except that the surface layer to be described later is included, and can be produced similarly. The surface layer also has a configuration of any conventional surface layer having features to be described later, and can be formed similarly. For example, the image bearing member as an electrophotographic photoconductor may have the same configuration as an image bearing member described in Japanese Patent Application Laid-Open No. 2012-078620, except the surface layer. In addition, the surface layer may be configured as described in Japanese Patent Application Laid-Open No. 2012-078620 except that the material is different.

Now, the image bearing member will be described in more detail by using an electrophotographic photoconductor as an example.

The electrophotographic photoconductor includes a conductive support, a photosensitive layer disposed on the conductive support, and a surface layer disposed on the photosensitive layer.

The conductive support is a member being capable of supporting the photosensitive layer and having conductivity. Examples of the conductive support include drums or sheets made of metal; plastic films including a metal foil laminated thereon; plastic films including a film of a conductive material deposited thereon; and metal members, plastic films, or papers including a conductive layer formed by application of a coating material consisting of a conductive material or consisting of a conductive material and a binder resin. Examples of the metal include aluminum, copper, chromium, nickel, zinc, and stainless steel, and examples of the conductive material include the metals, indium oxide, and tin oxide.

The photosensitive layer is a layer for formation of an electrostatic latent image of an intended image on the surface of the image bearing member through light exposure to be described later. The photosensitive layer may be a monolayer, or composed of a plurality of layers laminated. Examples of the photosensitive layer include a monolayer containing a charge transport compound and a charge generation compound, and a laminate of a charge transport layer containing a charge transport compound and a charge generation layer containing a charge generation compound.

The image bearing member may further include any additional component that allows the advantageous effects of the present embodiment to be achieved, in addition to the conductive support and the photosensitive layer. Examples of the additional component include an intermediate layer. The intermediate layer is, for example, a layer which is disposed between the conductive support and the photosensitive layer and has barrier function and adhesive function.

The surface layer is a layer constituting the surface of the image bearing member, and positioned at the outermost portion in the cross-section of the image bearing member. The thickness of the surface layer may be appropriately determined in accordance with the type of the image bearing member, and is preferably 0.2 μm or larger and 15 μm or smaller, and more preferably 0.5 μm or larger and 10 μm or smaller.

The surface layer in the image bearing member according to the present invention is formed of a polymerization-cured product of a composition containing a polymerizable monomer and a metal oxide particle surface-treated with a surface treating agent having a silicone side chain.

In the present embodiment, a surface layer using combination of a polymerizable monomer and a metal oxide particle surface-treated with a surface treating agent having a silicone side chain successfully provides an image bearing member capable of retaining both of high mechanical properties (abrasion resistance and scratch resistance) and toner releasability (cleanability). Although the reason is unclear, it is inferred as follows.

When a metal oxide particle is surface-treated with a surface treating agent having a silicone side chain, the metal oxide particle is efficiently hydrophobized, resulting in the presence of a high concentration of the silicone chain on the surface. If a composition is prepared by using metal oxide particles surface-treated in this manner and a polymerizable monomer and a surface layer of an image bearing member is formed from the polymerization-cured product, the surface-treated metal oxide particles cause lower friction and lower toner adhesion than untreated metal oxide particles because of a high concentration of the silicone chain present on the surface of the particle, leading to enhancement of the cleanability of the surface of the image bearing member.

In addition, the metal oxide particle surface-treated with a surface treating agent having a silicone side chain can be homogeneously dispersed all over the film thickness direction of the surface layer. In addition, when the surface of the image bearing member including a surface layer formed of a polymerization-cured product in which metal oxide particles are homogeneously dispersed is worn away through repeated use, polymer portions (i.e., portions consisting of the cured polymer of the polymerizable monomer) are preferentially worn away, and the metal oxide particles present in the inside appear in the surface portion. Accordingly, the effect of the metal oxide particle is exhibited even after the outermost surface of the surface layer is worn away, and hence both of high mechanical properties (abrasion resistance and scratch resistance) and toner releasability (cleanability) are retained.

(1) Metal Oxide Particle Surface-Treated with Surface Treating Agent Having Silicone Chain as Side Chain (1)-1 Metal Oxide Particle Examples of metal oxide of the surface-treated metal oxide particles include silica (silicon oxide), magnesium oxide, zinc oxide, lead oxide, alumina (aluminum oxide), tin oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium dioxide, niobium oxide, molybdenum oxide, vanadium oxide, and copper-aluminum oxide. Among them, alumina ($Al_2O_3$), tin oxide ($SnO_2$), titanium dioxide ($TiO_2$), and copper-aluminum composite oxide ($CuAlO_2$) are preferred. One type of metal oxide particle may be used, or two or more types of metal oxide particles may be used in combination.

The metal oxide particle may be a composite fine particle having a core-shell structure in which an outer shell consisting of the above-described metal oxide is formed on the surface of a core member. Examples of the material of the core member (core) include barium sulfate, alumina, and silica.

The number average primary particle size of the metal oxide particles is preferably 10 nm or larger and 200 nm or smaller, and more preferably 20 nm or larger and 150 nm or smaller. If the number average primary particle size of the metal oxide particles is smaller than 10 nm, the resulting abrasion resistance may be insufficient. If the number average primary particle size of the metal oxide particles is larger than 200 nm, the metal oxide particle is likely to sink in a dispersion in dispersing the metal oxide particles in a solvent for formation of the surface layer, which may complicate production of the image bearing member. The particle size distribution of the metal oxide particles can be appropriately adjusted within a range that allows the advantageous effects of the present embodiment to be achieved. The standard deviation, a, of the particle size of the metal oxide particles is, for example, 10 nm or larger and 30 nm or smaller.

The number average primary particle size of the metal oxide particles can be measured, for example, as follows. An enlarged photograph taken with a scanning electron microscope (manufactured by JEOL Ltd.) at a magnification of 10,000× is fed to a scanner; and 300 particle images randomly selected from the resulting photograph image, with images of agglomerated particles excluded, are binarized by using the automated image processing/analysis system "LUZEX AP" (manufactured by NIRECO CORPORATION, "LUZEX" is a registered trademark possessed by the company, software Ver.1.32) to calculate the horizontal Feret's diameter of each particle image, and the average value is calculated as the number average primary particle size. Here, the horizontal Feret's diameter refers to the length of the side parallel to the x axis in a rectangle circumscribing the binarized particle image.

From the viewpoint of the film strength of the surface layer, the number average primary particle size of the metal oxide particles can be appropriately adjusted in accordance with other components which may be contained in the surface layer and the contents thereof.

(1)-2 Surface Treating Agent Having Silicone Chain as Side Chain

The surface treating agent for surface treatment of the metal oxide particle is a surface treating agent having a silicone side chain. This surface treating agent is one having a silicone side chain of a polymer main chain and further having a surface treating functional group.

The polymer main chain of the surface treating agent is preferably a (meth)acrylate copolymer chain or a silicone chain.

Examples of the surface treating functional group include a carboxylic acid group, a hydroxy group, and an alkoxysilyl group.

The silicone side chain or a main chain is preferably one having dimethylsiloxane structure as repeating units, and the number of repeating units is preferably 3 or more and 100 or less, more preferably 3 or more and 50 or less, and even more preferably 3 or more and 30 or less.

The molecular weight of the surface treating agent having a silicone side chain is preferably 1,000 or higher and 300,000 or lower in terms of number average molecular weight.

Specific examples of the surface treating agent having a silicone side chain branched from an acrylic main chain include SYMAC US-350 (manufactured by TOAGOSEI CO., LTD.); and KP-541, KP-574, and KP-578 (all manufactured by Shin-Etsu Chemical Co., Ltd.).

Specific examples of the surface treating agent having a silicone side chain branched from a silicone main chain include KF-9908 and KF-9909 (all manufactured by Shin-Etsu Chemical Co., Ltd.).

One surface treating agent may be used singly, or two or more surface treating agents may be used in a mixture.

The method for surface-treating the metal oxide particle with the surface treating agent having a silicone side chain is not limited. For surface treatment of the metal oxide particle, for example, the metal oxide particles are dispersed in an alcohol dispersion medium such as methanol and 2-butanol, the surface treating agent is added thereto, and the dispersion medium is then volatilized. After the dispersion medium is volatilized, the metal oxide particles may be heated.

The amount of the surface treating agent having a silicone side chain to be used is preferably 0.5 parts by mass or more and 20 parts by mass or less, and more preferably 1 part by mass or more and 10 parts by mass or less, relative to 100 parts by mass of the metal oxide before treatment.

The condition of surface treatment by the surface treating agent having a silicone side chain on the metal oxide particle can be confirmed through thermogravimetry/differential thermal analysis (TG/DTA), mass spectrometry, etc.

(1)-3 Polymerizable Surface Treating Agent

It is preferable that the metal oxide particle surface-treated with the surface treating agent having a silicone side chain further have a polymerizable group. The polymerizable group may be any of radical polymerizable groups and cationic polymerizable groups, and is preferably a radical polymerizable group. The polymerizable group additionally possessed by the surface-treated metal oxide particle allows the metal oxide particle to be present in a state in which the metal oxide particle is chemically bonding to the polymer of monomers in a polymerization-cured product forming the surface layer, and hence enhanced strength can be imparted to the surface layer.

The polymerizable group can be supported on the surface of the metal oxide particle through surface treatment with a polymerizable surface treating agent having a polymerizable group and a surface treating functional group. The surface treating functional group of the polymerizable surface treating agent is a group reactive with polar groups such as a hydroxy group present on the surface of the metal oxide particle. The polymerizable functional group of the polymerizable surface treating agent is a group having a polymerizable monomer (in particular, radical polymerizable monomer) or a carbon-carbon double bond and being radical polymerizable, and examples thereof include a vinyl group and a (meth)acryloyl group.

The polymerizable surface treating agent is preferably a silane coupling agent having a radical polymerizable group. Specific examples thereof include compounds represented by formulas S-1 to S-31.

$CH_2{=}CHSi(CH_3)(OCH_3)_2$ S-1:

$CH_2{=}CHSi(OCH_3)_3$ S-2:

$CH_2{=}CHSiCl_3$ S-3:

$CH_2{=}CHCOO(CH_2)_2Si(CH_3)(OCH_3)_2$ S-4:

$CH_2{=}CHCOO(CH_2)_2Si(OCH_3)_3$ S-5:

$CH_2{=}CHCOO(CH_2)_2Si(OC_2H_5)(OCH_3)_2$ S-6:

$CH_2{=}CHCOO(CH_2)_3Si(OCH_3)_3$ S-7:

$CH_2{=}CHCOO(CH_2)_2Si(CH_3)Cl_2$ S-8:

$CH_2{=}CHCOO(CH_2)_2SiCl_3$ S-9:

$CH_2{=}CHCOO(CH_2)_3Si(CH_3)Cl_2$ S-10:

$CH_2{=}CHCOO(CH_2)_3SiCl_3$ S-11:

$CH_2{=}C(CH_3)COO(CH_2)_2Si(CH_3)(OCH_3)_2$ S-12:

$CH_2{=}C(CH_3)COO(CH_2)_2Si(OCH_3)_3$ S-13:

$CH_2{=}C(CH_3)COO(CH_2)_3Si(CH_3)(OCH_3)_2$ S-14:

$CH_2{=}C(CH_3)COO(CH_2)_3Si(OCH_3)_3$ S-15:

$CH_2{=}C(CH_3)COO(CH_2)_2Si(CH_3)Cl_2$ S-16:

$CH_2{=}C(CH_3)COO(CH_2)_2SiCl_3$ S-17:

$CH_2{=}C(CH_3)COO(CH_2)_3Si(CH_3)Cl_2$ S-18:

$CH_2{=}C(CH_3)COO(CH_2)_3SiCl_3$ S-19:

$CH_2{=}CHSi(C_2H_5)(OCH_3)_2$ S-20:

$CH_2{=}C(CH_3)Si(OCH_3)_3$ S-21:

$CH_2{=}C(CH_3)Si(OC_2H_5)_3$ S-22:

$CH_2{=}CHSi(OC_2H_5)_3$ S-23:

$CH_2{=}C(CH_3)Si(CH_3)(OCH_3)_2$ S-24:

$CH_2{=}CHSi(CH_3)Cl_2$ S-25:

$CH_2{=}CHCOOSi(OCH_3)_3$ S-26:

$CH_2{=}CHCOOSi(OC_2H_5)_3$ S-27:

$CH_2{=}C(CH_3)COOSi(OCH_3)_3$ S-28:

$CH_2{=}C(CH_3)COOSi(OC_2H_5)_3$ S-29:

$CH_2{=}C(CH_3)COO(CH_2)_3Si(OC_2H_5)_3$ S-30:

$CH_2{=}CHCOO(CH_2)_2Si(CH_3)_2(OCH_3)$ S-31:

One polymerizable surface treating agent may be used singly, or two or more polymerizable surface treating agents may be used in combination.

The method for allowing the metal oxide particle to support the polymerizable group on the surface is not limited, and known surface treatment techniques for metal oxide particles can be used. For example, a surface treatment method for metal oxide particles with a surface-modifying agent as described in Japanese Patent Application Laid-Open No. 2012-078620 can be used.

In the present invention, it is preferred to subject the metal oxide particles to surface treatment with the polymerizable surface treating agent followed by surface treatment with the surface treating agent having a silicone side chain. This is because if surface treatment with the polymerizable surface treating agent is performed after surface treatment with the surface treating agent having a silicone side chain, the oil repellent effect of the silicone chain complicates introduction of the polymerizable surface treating agent to the surface of the metal oxide particle, which may make the effect of the polymerizable surface treating agent insufficient.

For example, a metal oxide particle subjected to polymerizable surface treatment is dispersed in an alcohol dispersion medium such as methanol and 2-butanol, the surface treating agent having a silicone side chain is added thereto and mixed together, and the dispersion medium is volatilized to afford a metal oxide particle surface-treated with the surface treating agent having a silicone side chain and having a polymerizable group.

The polymerizable group possessed by the metal oxide particle can be confirmed through thermogravimetry/differential thermal analysis (TG/DTA), mass spectrometry, etc.

(2) Polymerizable Monomer

The polymerizable monomer contained in the composition together with the metal oxide particle surface-treated with the surface treating agent having a silicone side chain is a compound which has a polymerizable group, and undergoes polymerization (curing) when being irradiated with an actinic ray such as an ultraviolet ray, a visible ray, and an electron beam, or when being provided with energy by heating or the like, and is thus converted to a resin to be typically used as a binder resin for an image bearing member such as a photoconductor. The term "polymerizable monomer" as used herein is intended not to include polymerizable silicone compounds and polymerizable perfluoropolyether compounds.

The polymerizable monomer is preferably a radical polymerizable monomer which cures through radical polymerization reaction. Examples of the polymerizable monomer include styrenic monomer, acrylic monomer, methacrylic monomer, vinyltoluene monomer, vinyl acetate monomer, and N-vinylpyrrolidone monomer, and examples of binder resin include polystyrene and polyacrylate.

The polymerizable group possessed by the polymerizable monomer is a group having a carbon-carbon double bond and being polymerizable. The polymerizable group is particularly preferably an acryloyl group ($CH_2{=}CHCO{-}$) or a methacryloyl group ($CH_2{=}C(CH_3)CO{-}$) because such groups can be cured with a small amount of light or in a short time.

Specific examples of the polymerizable monomer include, but are not limited to, compounds M1 to M11. In the following formulas, R denotes an acryloyl group, and R denotes a methacryloyl group.

M1

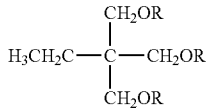

M2

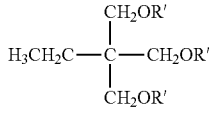

M3

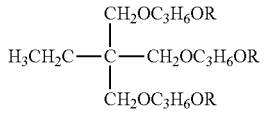

M4

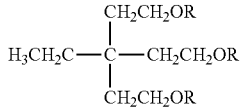

M5

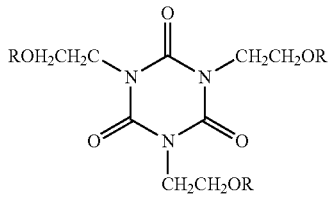

M6

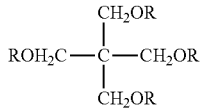

M7

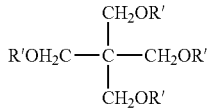

M8

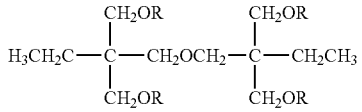

-continued

M9

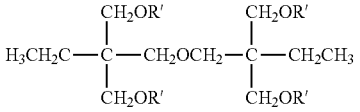

M10

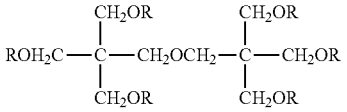

M11

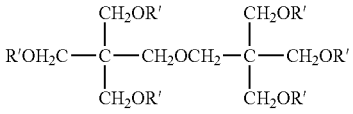

Each of the polymerizable monomers can be synthesized by using a known method, and is available as a commercial product. The polymerizable monomer is preferably a compound having three or more polymerizable groups, from the viewpoint of formation of a surface layer having high crosslinking density and thus having high hardness.

(3) Lubricant

Preferably, the composition to be used for the surface layer of the image bearing member further contains a lubricant. In prior art, a surface layer of an image bearing member using a lubricant and a surface-treated metal oxide fine particle in combination has been proposed. However, the surface-treated metal oxide fine particle has a tendency to agglomerate because of the low surface energy of the lubricant, disadvantageously leading to lowered cleanability in some cases. In contrast, use of the metal oxide particle surface-treated with the surface treating agent having a silicone side chain and a lubricant in combination as in the present invention imparts high dispersibility to the metal oxide fine particle even in the presence of the lubricant. Presumably, higher affinity between the lubricant and the surface-treated metal oxide particle allows the lubricant to have a higher tendency to be present over the bulk of the surface layer, and a sufficient amount of the lubricant for retaining high cleanability can remain on the surface layer even after the outermost surface is worn away.

The lubricant may be any lubricant capable of reducing friction between an image bearing member such as an electrophotographic photoconductor and a member to be contacted therewith, and a solid lubricant or a liquid lubricant can be used.

Examples of the solid lubricant include molybdenum disulfide, organic molybdenum compounds, melamine cyanurate, boron nitride, graphite, mica, talc, fluororesin, silicone resin, polyethylene resin, polypropylene resin, nylon resin, acrylic resin, and urethane resin. Any of the solid lubricants in the form of particles or powder can be suitably used, and, for example, silicone fine particles and fluororesin fine particles can be used.

Examples of the liquid lubricant include silicone compounds and perfluoropolyether compounds. Among them, polymerizable silicone compounds and polymerizable perfluoropolyether compounds having a polymerizable functional group are preferred. The compounds can react with a polymerizable monomer to form a crosslinked structure, and hence a surface layer with high strength can be obtained.

(3)-1 Polymerizable Silicone Compound

The polymerizable silicone compound to be used for the lubricant in the present invention is a silicone compound having a radical polymerizable functional group, and preferably a silicone compound having one or more radical polymerizable functional groups and having dimethylsiloxane structure as repeating units. In particular, an acryloyloxy group and a methacryloyloxy group are useful as the radical polymerizable functional group. Regarding the number of radical polymerizable functional groups, bifunctional or higher-functional polymerizable silicone compounds can be suitably used, rather than monofunctional polymerizable silicone compounds, for the purpose of enhancing the crosslinking density, and a reactive silicone oil having di(meth) acrylate at both terminals exhibits good properties. The molecular weight of the reactive silicone oil is preferably 20,000 or lower, and more preferably 10,000 or lower. Molecular weights of 20,000 or lower provide high compatibility, and hence the surface layer tends to have high surface smoothness.

Specific examples of reactive silicone oils having a radical polymerizable functional group and of reactive silicone oils having two radical polymerizable functional groups are represented by general formulas (1) and (2), respectively.

General formula (1)

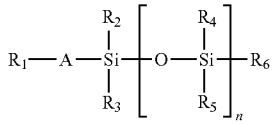

In general formula (1), $R_1$ denotes an acryloyloxy group, a methacryloyloxy group, or the like;

$R_2$, $R_3$, $R_4$, $R_5$, and $R_6$ each independently denote a hydrogen atom, a $C_{1-12}$ alkyl group, or an aryl group;

A denotes a single bond; and n is an integer of 2 or more.

General formula (2)

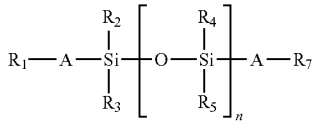

In general formula (2), $R_1$ and $R_7$ each denote an acryloyloxy group, a methacryloyloxy group, or the like;

$R_2$, $R_3$, $R_4$, and $R_5$ each independently denote a hydrogen atom, a $C_{1-12}$ alkyl group, or an aryl group;

A denotes a $C_{2-6}$ alkylene group or a single bond; and n is an integer of 2 or more.

In general formulas (1) and (2), a radical polymerizable functional group is positioned at each end of the polysiloxane structure. However, the position of a radical polymerizable functional group in the polymerizable silicone compound to be used for the lubricant in the present invention is not limited to ends, and the polymerizable silicone compound can be effectively used even in the situation that a side chain portion of the siloxane structure is substituted with a radical polymerizable functional group.

The polymerizable silicone compound may be a polymerizable silicone-modified polymer, which has a silicone chain and polymerizable functional group as side chains. Examples of the silicone side chain include dimethylsilicones including 3 or more and 100 or less repeating units.

Commercially available products of these polymerizable silicone compounds can be used. Examples of such commercially available products include X-22-164A (molecular weight: 860, manufactured by Shin-Etsu Chemical Co., Ltd.), X-22-164B (manufactured by Shin-Etsu Chemical Co., Ltd.), X-22-164C (manufactured by Shin-Etsu Chemical Co., Ltd.), X-24-164E (manufactured by Shin-Etsu Chemical Co., Ltd.), X-22-174DX (manufactured by Shin-Etsu Chemical Co., Ltd.), X-24-8201 (manufactured by Shin-Etsu Chemical Co., Ltd.), X-22-2426 (manufactured by Shin-Etsu Chemical Co., Ltd.), Silaplane FM-7711 (manufactured by CHISSO CORPORATION), Silaplane FM-07721 (manufactured by CHISSO CORPORATION), Silaplane FM-7725 (manufactured by CHISSO CORPORATION), Silaplane 0711 (manufactured by CHISSO CORPORATION), mono-terminal Silaplane FM-0721 (molecular weight: 5,000, manufactured by CHISSO CORPORATION), mono-terminal Silaplane FM-0725 (molecular weight: 10,000, manufactured by CHISSO CORPORATION), mono-terminal Silaplane TM-0701 (molecular weight: 423, manufactured by CHISSO CORPORATION), mono-terminal Silaplane TM-0701T (molecular weight: 423, manufactured by CHISSO CORPORATION), BYK-UV3500 (manufactured by BYK Japan KK), BYK-UV3510 (manufactured by BYK Japan KK), BYK-UV3570 (manufactured by BYK Japan KK), TEGO Rad 2100 (manufactured by Tego Chemie Service GmbH), TEGO Rad 2200N (manufactured by Tego Chemie Service GmbH), TEGO Rad 2250 (manufactured by Tego Chemie Service GmbH), EEGO Rad 2500 (manufactured by Tego Chemie Service GmbH), TEGO Rad 2600 (manufactured by Tego Chemie Service GmbH), TEGO Rad 2700 (manufactured by Tego Chemie Service GmbH), Fulshade (manufactured by TOYO INK CO., LTD.), and 8SS-723 (manufactured by Taisei Fine Chemical Co., Ltd.).

The functional group equivalent of the reactive silicone compound is preferably 150 g/mol or more and 15,000 g/mol or less, more preferably 500 g/mol or more and 6,000 g/mol or less, and even more preferably 1,000 g/mol or more and 4,000 g/mol or less. One reactive silicone compound may be used, or two or more reactive silicone compounds may be used in a mixture. The reactive silicone compound applicable to the present invention is not limited to the above reactive silicone compounds.

(3)-2 Polymerizable Perfluoropolyether Compound

The polymerizable perfluoropolyether compound (hereinafter, often abbreviated as "polymerizable PFPE compound") to be used for the lubricant in the present invention is an oligomer or polymer including repeating units of perfluoroalkylene ether. Examples of repeating units of perfluoroalkylene ether include those of perfluoromethylene ether, those of perfluoroethylene ether, and those of perfluoropropylene ether.

In the case that a plurality of structural units is included, the structural units may be forming a block copolymer structure, or a random copolymer structure.

The polymerizable PFPE compound preferably has a radical polymerizable group as a polymerizable group. The radical polymerizable group included reacts with a radical polymerizable monomer to form a polymerization-cured product, which prevents the polymerizable PFPE compound from moving to the surface and allows the polymerizable PFPE compound to be present all over the film thickness direction of the surface layer.

The number average molecular weight of the polymerizable PFPE compound is preferably 300 or higher and 20,000 or lower, and more preferably 500 or higher and 20,000 or lower.

The polymerizable PFPE compound is preferably a polymerizable PFPE compound represented by general formula (3).

General formula (3)

$$(X)_q\text{-A-}CF_2O(CF_2CF_2O)_m(CF_2O)_nCF_2\text{-A-}(X)_q \quad (3)$$

In general formula (3), m and n are each an integer of 0 or more, and satisfy $m+n \geq 5$;

A independently in each occurrence denotes a (q+1)-valent linking group;

X denotes a radical polymerizable group; and q denotes an integer of 1 or more.

Each of m and n is preferably an integer of 2 to 20, and more preferably an integer of 2 to 15.

In formula (3), the perfluoroethylene ether structural unit and the perfluoromethylene ether structural unit may be forming a block copolymer structure, or a random copolymer structure.

Examples of the linking group denoted as A in general formula (3) include linking groups having structures set forth below. In the following formulas, *1 denotes a binding site to a carbon atom at an end of $—CF_2O(CF_2CF_2O)_m(CF_2O)_nCF_2—$ in general formula (3), and *2 denotes a binding site to X in general formula (3).

A1

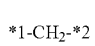

A2

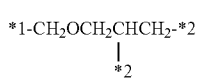

A3

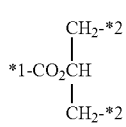

A4

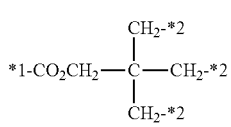

A5

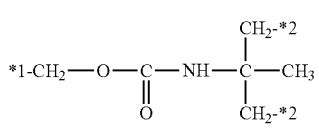

A6

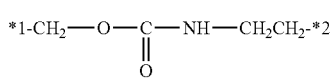

-continued

A7

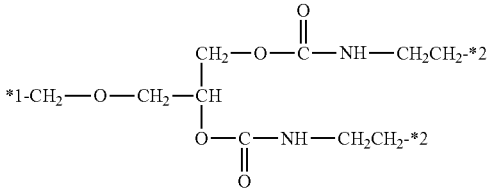

A8

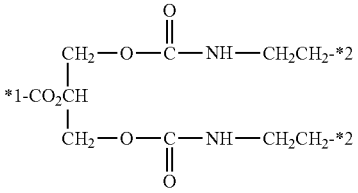

A9

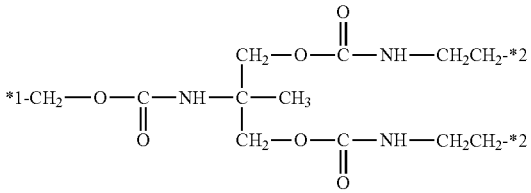

A10

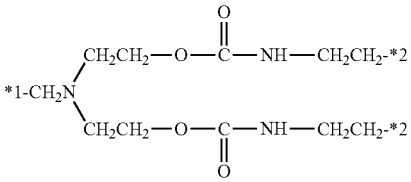

A11

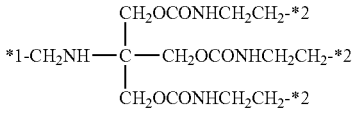

A12

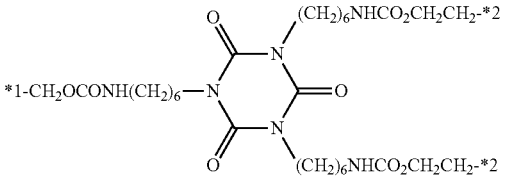

A13

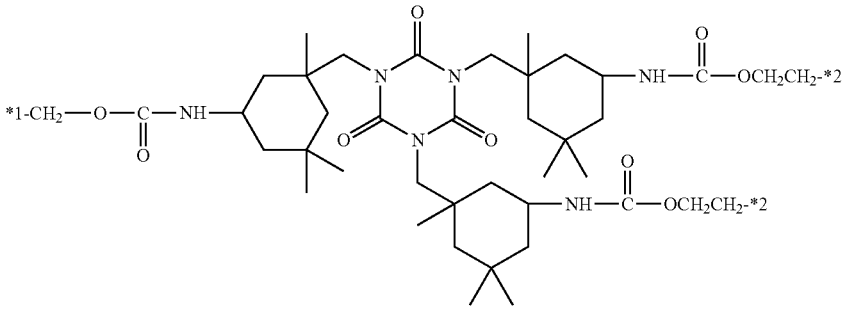

The radical polymerizable group denoted as X is not limited and may be any radical polymerizable group having a carbon-carbon double bond, and an acryloyl group and a methacryloyl group are particularly useful.

The radical polymerizable group included at each end of the PFPE chain reacts with a radical polymerizable monomer to form a high-order crosslinked film, and prevents the PFPE compound from moving to the surface and allows the PFPE compound to tend to be present all over the film thickness direction of the surface layer, which is particularly preferred from the viewpoint of enhancement of the abrasion resistance and cleanability of the image bearing member.

Specific examples of the polymerizable PFPE compound are shown below, though the polymerizable PFPE compound is not limited thereto. PFPE-1 to PFPE-10 are specific examples of the polymerizable PFPE compound having the structure represented by general formula (3), and PFPE-11 and PFPE-12 are specific examples of the polymerizable PFPE compound except PFPE-1 to PFPE-10. In the following formulas, X denotes an acryloyloxy group or a methacryloyloxy group, and m and n each independently denote an integer of 0 or more, and satisfy m+n≥5.

PFPE-1

$$XCH_2—CF_2O(CF_2CF_2O)_m(CF_2O)_nCF_2—CH_2X$$

PFPE-2

$$X(CH_2CH_2O)_pCH_2—CF_2O(CF_2CF_2O)_m(CF_2O)_nCF_2—CH_2(OCH_2CH_2)_pX$$

PFPE-3

$$XCH_2CH_2NHCOOCH_2—CF_2O(CF_2CF_2O)_m(CF_2O)_nCF_2—CH_2OCONHCH_2CH_2X$$

PFPE-4

$$\begin{array}{l} XCHCH_2OCH_2—CF_2O(CF_2CF_2O)_m(CF_2O)_nCF_2—CH_2OCH_2CHX \\ \quad\;\; | \qquad\qquad\qquad\qquad\qquad\qquad\qquad\qquad\qquad\qquad\qquad\qquad | \\ \quad\;\; XCH_2 \qquad\qquad\qquad\qquad\qquad\qquad\qquad\qquad\qquad\qquad\qquad\qquad CH_2X \end{array}$$

PFPE-5

$$\begin{array}{l} X(CH_2)_2NHCOOCHCH_2OCH_2—CF_2O(CF_2CF_2O)_m(CF_2O)_nCF_2—CH_2OCH_2CHOCONH(CH_2)_2X \\ \qquad\qquad\quad | \qquad\qquad\qquad\qquad\qquad\qquad\qquad\qquad\qquad\qquad\qquad\qquad | \\ \quad X(CH_2)_2NHCOOCH_2 \qquad\qquad\qquad\qquad\qquad\qquad\qquad\qquad\qquad\qquad\qquad\qquad CH_2OCONH(CH_2)_2X \end{array}$$

-continued

PFPE-6

$$(XCH_2)_2(CH_3)CNHCOOCH_2—CF_2O(CF_2CF_2O)_m(CF_2O)_nCF_2—CH_2OCONHC(CH_3)(CH_2X)_2$$

PFPE-7

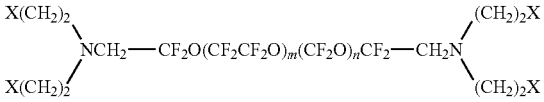

PFPE-8

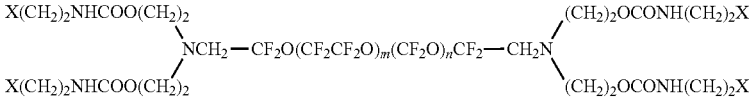

PFPE-9

$$(XCH_2)_2CHO_2C—CF_2O(CF_2CF_2O)_m(CF_2O)_nCF_2—CO_2CH(CH_2X)_2$$

PFPE-10

$$(XCH_2)_3CCH_2O_2C—CF_2O(CF_2CF_2O)_m(CF_2O)_nCF_2—CO_2CH_2C(CH_2X)_3$$

PFPE-11

$$CF_3CF_2CF_2CF_2O(CF_2CF_2CF_2O)_nCF_2CF_2—CH_2OCONHC(CH_3)(CH_2X)_2$$

PFPE-12

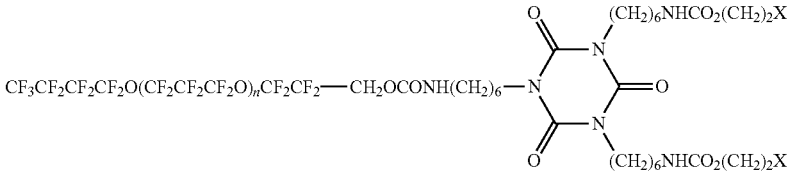

Specific examples of the PFPE compound having a radical polymerizable group include Fluorolink AD1700, MD500, MD700, 5101X, 5113X, and Fomblin MT70 manufactured by Solvay Specialty Polymers ("FLUOROLINK" and "FOMBLIN" are each a registered trademark possessed by the company); Optool DAC manufactured by DAIKIN INDUSTRIES, LTD.; KY-1203 manufactured by Shin-Etsu Chemical Co., Ltd.; and MEGAFACE RS-78 and MEGAFACE RS-90 manufactured by DIC Corporation.

The radical polymerizable PFPE compound can be appropriately synthesized by using a PFPE compound having a hydroxy group or a carboxy group at an end as a raw material, and such synthesized products may be used.

Specific examples of PFPE compounds having a hydroxy group at an end include Fomblin D2, Fluorolink D4000, Fluorolink E10H, 5158X, 5147X, and Fomblin Ztetraol manufactured by Solvay Specialty Polymers, and Demnum-SA manufactured by DAIKIN INDUSTRIES, LTD. Specific examples of PFPE having a carboxy group at an end include Fomblin ZDIZAC4000 manufactured by Solvay Specialty Polymers and Demnum-SH manufactured by DAIKIN INDUSTRIES, LTD.

The content of the polymerizable PFPE compound in the composition to form the surface layer is, for example, preferably 10 parts by mass or more, and more preferably 20 parts by mass or more, relative to 100 parts by mass of the polymerizable monomer, from the viewpoint of achievement of sufficient cleanability. The content of the polymerizable PFPE compound in the composition to form the surface layer is, for example, preferably, 100 parts by mass or less, and more preferably 70 parts by mass or less, from the viewpoint of achievement of sufficient abrasion resistance.

(4) Method for Producing Image Bearing Member Including Surface Layer

The image bearing member according to the present invention can be produced by using a known method for producing an image bearing member, except that a coating solution for a surface layer, which is described later, is used. For example, the image bearing member as an electrophotographic photoconductor can be produced by using a method including: applying a coating solution for a surface layer onto the surface of a photosensitive layer formed on a conductive support; and irradiating the applied coating solution for a surface layer with an actinic ray or heating the applied coating solution for a surface layer to allow the polymerizable monomer in the coating solution for a surface layer to undergo polymerization.

The coating solution for a surface layer to be used for formation of the surface layer contains a polymerizable monomer and a metal oxide particle surface-treated with a surface treating agent having a silicone side chain. The coating solution for a surface layer can be constituted with the above-described composition itself.

The coating solution may contain a solvent. One or more solvents may be used for the solvent. Examples of the solvent include methanol, ethanol, n-propyl alcohol, isopropyl alcohol, n-butanol, t-butanol, sec-butanol, benzyl alcohol, toluene, xylene, methyl ethyl ketone, cyclohexane, ethyl acetate, butyl acetate, methylcellosolve, ethylcellosolve, tetrahydrofuran, 1,3-dioxane, 1,3-dioxolane, pyridine, and diethylamine.

The coating solution may contain a radical polymerization initiator to accelerate curing in forming the surface layer described later. The content of the radical polymerization initiator is preferably 0.1 parts by mass or more and 40 parts by mass or less, and more preferably 0.5 parts by mass or more and 20 parts by mass or less, relative to 100 parts by mass of radical polymerizable components contained in the coating solution (e.g., the total amount of the radical polymerizable PFPE compound and the radical polymerizable monomer).

The coating solution for a surface layer can be prepared by adding the polymerizable monomer and the surface-treated metal oxide particle, and, as desired, a lubricant and a radical polymerization initiator to a solvent. To form the surface layer, a coating film of the prepared coating solution for a surface layer is formed, and the coating film is dried and cured (causing polymerization by irradiation with an actinic ray such as an ultraviolet ray and an electron beam).

In the case that the metal oxide fine particle to be used has a polymerizable group, the polymerizable monomer and the metal oxide fine particle having a polymerizable group (and a lubricant having a polymerizable group, contained as desired) in the surface layer constitute an integrated polymer (polymerization-cured product) constituting the surface layer. Analysis of the polymerization-cured product by using a known instrumental analysis technique such as pyrolysis GC-MS, nuclear magnetic resonance (NMR), a Fourier transform infrared spectrometer (FT-IR), and elemental analysis can confirm that the polymerization-cured product is a polymer of the polymerizable compound.

(5) Image Forming Apparatus Including Image Bearing Member

As described above, the image bearing member is used, for example, as an electrophotographic photoconductor (organic photoconductor) for electrophotographic image forming apparatuses. For example, the image forming apparatus includes: the image bearing member; a charging device to charge the surface of the image bearing member; a light exposure apparatus to irradiate the charged surface of the image bearing member with light to form an electrostatic latent image; a developing device to feed a toner to the image bearing member on which the electrostatic latent image has been formed to form a toner image; a transfer device to transfer the toner image on the surface of the image bearing member to a recording medium; and a cleaning apparatus to remove a toner remaining on the surface of the image bearing member after transferring the toner image to the recording medium.

The image bearing member is applied to an image forming method including: feeding a toner to the surface of the image bearing member on which an electrostatic latent image has been formed to form a toner image corresponding to the electrostatic latent image on the surface of the image bearing member; transferring the toner image from the surface of the image bearing member to a recording medium; and removing the toner remaining on the surface of the image bearing member with a cleaning apparatus. The image forming method is performed, for example, by using the above image forming apparatus.

FIG. 1 is a schematic illustrating one example of configurations of an image forming apparatus including the image bearing member. Image forming apparatus 100 illustrated in FIG. 1 includes image reading section 110, image processing section 30, image forming section 40, sheet conveyance section 50, and fixing apparatus 60.

Image forming section 40 includes image forming units 41Y, 41M, 41C, and 41K to form an image with a toner of Y (yellow), M (magenta), C (cyan), or K (black). They have an identical configuration except a toner to be contained therein, and thus the signs indicating the color are occasionally omitted hereinafter. Image forming section 40 further includes intermediate transfer unit 42 and secondary transfer unit 43. Each of them corresponds to a transfer device.

Image forming unit 41 includes light exposure apparatus 411, developing device 412, image bearing member 413, which has been described in the above, charging device 414, and drum cleaning apparatus 415. Charging device 414 is, for example, a corona charger. Charging device 414 may be a contact charging device to charge image bearing member 413 by bringing a contact charging member such as a charging roller, a charging brush, and a charging blade into contact with image bearing member 413. Light exposure apparatus 411 includes, for example, a semiconductor laser as a light source and a light deflector (polygon motor) to irradiate image bearing member 413 with a laser beam in accordance with an image to be formed.

Developing device 412 is a developing device with a two-component developing system. For example, developing device 412 includes: a developing container to contain a two-component developer; a developing roller (magnetic roller) rotatably disposed at an opening of the developing container; a dividing wall to separate the inside of the developing container in such a way that the two-component developer can communicate therethrough; a conveyance roller to convey the two-component developer in the opening side of the developing container toward the developing roller; and a stirring roller to stir the two-component developer in the developing container. In the developing container, for example, a two-component developer is contained.

In the case that a lubricant is applied onto image bearing member 413, the lubricant is disposed, for example, in drum cleaning apparatus 415 or between drum cleaning apparatus 415 and charging device 414 so that the lubricant can contact the surface of the image bearing member after transfer. Alternatively, the lubricant may be fed, as an external additive for the two-component developer, to the surface of image bearing member 413 in developing.

Intermediate transfer unit 42 includes: intermediate transfer belt 421; primary transfer roller 422 to bring intermediate transfer belt 421 into pressure contact with image bearing member 413; a plurality of support rollers 423 including back-up roller 423A; and belt cleaning apparatus 426. Intermediate transfer belt 421 is laid as a loop on the plurality of support rollers 423 in a tensioned state. Intermediate transfer belt 421 runs in the direction of arrow A at a constant speed through the rotation of a drive roller of at least one of the plurality of support rollers 423.

Secondary transfer unit 43 includes: endless, secondary transfer belt 432; and a plurality of support rollers 431 including secondary transfer roller 431A. Secondary transfer belt 432 is laid as a loop on secondary transfer roller 431A and support roller 431 in a tensioned state.

For example, fixing apparatus 60 includes: fixing roller 62; endless, heating belt 10 covering the outer peripheral surface of fixing roller 62 to heat and melt a toner constituting a toner image on sheet S; and pressure roller 63 to press sheet S toward fixing roller 62 and heating belt 10. Sheet S corresponds to a recording medium.

Image forming apparatus 100 further includes image reading section 110, image processing section 30, and sheet conveyance section 50. Image reading section 110 includes sheet feeding apparatus 111 and scanner 112. Sheet conveyance section 50 includes sheet feeding section 51, sheet ejection section 52, and conveyance pathway section 53. Three sheet feed tray units 51*a* to 51*c* constituting sheet feeding section 51 contain preset, different types of sheet S (standard paper or special paper) identified on the basis of the basis weight, size, or the like. Conveyance pathway section 53 includes a plurality of pairs of conveyance rollers including pair of registration rollers 53*a*.

Image formation with image forming apparatus 100 will be described.

Scanner 112 optically scans and reads original image D on the contact glass. CCD sensor 112*a* reads a reflected light from original image D to acquire input image data. The input image data are subjected to predetermined image processing in image processing section 30, and sent to light exposure apparatus 411.

Image bearing member 413 rotates at a constant rotation speed. Charging device 414 negatively charges the surface of image bearing member 413 uniformly. In light exposure apparatus 411, the polygon mirror of the polygon motor rotates at a high speed, and laser beams each corresponding to a color component of the input image data extend along the axis direction of image bearing member 413, and applied onto the outer peripheral surface of image bearing member 413 along the axis direction. Thus, an electrostatic latent image is formed on the surface of image bearing member 413.

In developing device 412, the toner particles are charged through stirring and conveying of the two-component developer in the developing container, and the two-component developer is conveyed to the developing roller and forms a magnetic brush on the surface of the developing roller. The charged toner particles electrostatically attach from the magnetic brush to a portion corresponding to the electrostatic latent image on image bearing member 413. Thus, the electrostatic latent image on the surface of image bearing member 413 is visualized and a toner image corresponding to the electrostatic latent image is formed on the surface of image bearing member 413. Here, "toner image" refers to an image-like arrangement of toners.

The toner image on the surface of image bearing member 413 is transferred to intermediate transfer belt 421 by intermediate transfer unit 42. Untransferred residual toners remaining on the surface of image bearing member 413 after transfer are removed by drum cleaning apparatus 415 including a drum cleaning blade to be brought into sliding contact with the surface of image bearing member 413.

As described above, the surface layer of image bearing member 413 is formed of a polymerization-cured product of a composition containing a polymerizable monomer and a metal oxide particle surface-treated with a surface treating agent having a silicone side chain, and the metal oxide fine particle is homogeneously dispersed all over the film thickness direction of the surface layer, not only in the surface portion of the surface layer. Accordingly, after the surface portion is worn away and lost, the metal oxide particle present in the inside appears in the surface portion to exert the function to exhibit abrasion resistance, scratch resistance, and cleanability for a long period.

Intermediate transfer belt 421 is brought into pressure contact with image bearing member 413 by primary transfer roller 422, and as a result a primary transfer nip is formed on each image bearing member. At the primary transfer nip, toner images of different colors are sequentially transferred to intermediate transfer belt 421 in an overlaying manner.

On the other hand, secondary transfer roller 431A is brought into pressure contact with back-up roller 423A via intermediate transfer belt 421 and secondary transfer belt 432. As a result, a secondary transfer nip is formed by intermediate transfer belt 421 and secondary transfer belt 432. Sheet S passes through the secondary transfer nip. Sheet S is conveyed to the secondary transfer nip by sheet conveyance section 50. Correction of inclination and adjustment of conveyance timing for sheet S are performed by a registration roller section provided with pair of registration rollers 53*a*.

When sheet S is conveyed to the secondary transfer nip, a transfer bias is applied to secondary transfer roller 431A. This transfer bias applied allows transfer of the toner image borne on intermediate transfer belt 421 to sheet S. Sheet S to which the toner image has been transferred is conveyed toward fixing apparatus 60 by secondary transfer belt 432.

Fixing apparatus 60 forms a fixing nip by heating belt 10 and pressure roller 63, and heats and pressurizes sheet S conveyed there at the fixing nip. As a result, the toner image is fixed on sheet S. Sheet S on which the toner image has been fixed is ejected out by sheet ejection section 52 including sheet ejection roller 52*a*.

Untransferred residual toners remaining on the surface of intermediate transfer belt 421 after secondary transfer are removed by belt cleaning apparatus 426 including a belt cleaning blade to be brought into sliding contact with the surface of intermediate transfer belt 421.

As described above, image bearing member 413 is excellent in abrasion resistance, scratch resistance, and cleanability, and exert these properties for a long period. Accordingly, image forming apparatus 100 can form images of intended image quality stably for a long period.

EXAMPLES

Hereinafter, the present invention will be specifically described with reference to Examples; however, the present invention is never limited thereto.

1. Synthesis of Lubricant (Radical Polymerizable Silicone Compound-A)

Radical polymerizable silicone compound-A was synthesized in the following manner.

Mixed together were 25 parts by mass of a polysiloxane compound having a methacryloxy group at one terminal ("Silaplane FM-0721" manufactured by CHISSO CORPORATION), 30 parts by mass of methacryloyloxyethyl isocyanate, 45 parts by mass of butyl methacrylate, and 200 parts by mass of methyl ethyl ketone, and the temperature was raised to 80° C. with stirring under nitrogen flow. Thereto, 1.6 parts by mass of azobisisobutyronitrile was added to subject to polymerization reaction for 2 hours, and 0.4 parts by mass of azobisisobutyronitrile was further added thereto to subject to polymerization for additional 2 hours. Then, a solution prepared by dissolving 25.2 parts by mass of 2-hydroxyethyl methacrylate and 0.6 parts by mass of tin octylate in 20 parts by mass of methyl ethyl ketone was added dropwise over approximately 10 minutes, and after the dropwise addition the resultant was reacted for 2 hours. To the resulting solution, cyclohexanone was added so that the nonvolatile content reached 50 mass % to afford a solution of radical polymerizable silicone compound-A. The weight average molecular weight of radical polymerizable silicone compound-A was approximately 24,000.

(Radical Polymerizable Perfluoropolyether Compound-A)

Perfluoropolyether compound (PFPE)-A (X=acryloyloxy group) was synthesized in the following manner.

Mixed together were 14.4 parts by mass of perfluoropolyether (P-1) having a hydroxy group at both terminals, 0.01 parts by mass of p-methoxyphenol as a polymerization inhibitor, 0.01 parts by mass of dibutyltin dilaurate as a urethanization catalyst, and 10 parts by mass of methyl ethyl ketone to initiate stirring under air flow, and the temperature was raised to 80° C.

$$HOCH_2—CF_2O(CF_2CF_2O)_m(CF_2O)_nCF_2—CH_2OH \quad \text{P-1}$$

In the structural formula, the average value of m is 8, and the average value of n is 5.

Then, 2.8 parts by mass of 2-(acryloyloxy)ethyl isocyanate was added thereto to react together with stirring at 80° C. for 10 hours.

After IR spectrum measurement confirmed the disappearance of an absorption peak derived from an isocyanate group around 2,360 $cm^{-1}$, the solvent was distilled off to afford 17.2 parts by mass of the following perfluoropolyether (PFPE-A).

$$XCH_2CH_2NHCOOCH_2—CF_2O(CF_2CF_2O)_m(CF_2O)_nCF_2—CH_2OCONHCH_2CH_2X \quad \text{PFPE-A}$$

In the structural formula, the average value of m is 8, the average value of n is 5, and X denotes an acryloyloxy group.

(PFPE-B)

PFPE-B (X=acryloyloxy group) was synthesized in the following manner.

Mixed together were 21.8 parts by mass of perfluoropolyether (P-2) having a hydroxy group at both terminals, 0.01 parts by mass of p-methoxyphenol, 0.01 parts by mass of dibutyltin dilaurate, and 20 parts by mass of methyl ethyl ketone to initiate stirring under air flow, and the temperature was raised to 80° C.

$$\begin{array}{l} HOCHCH_2OCH_2—CF_2O(CF_2CF_2O)_m(CF_2O)_nCF_2—CH_2OCH_2CHOH \\ \quad\;\; | \qquad\qquad\qquad\

The materials and surface treating agents for the surface-treated metal oxide particles are listed in Table 1.

TABLE 1

| | Metal oxide particle before treatment | | Silicone surface treating agent | | Reactive surface treating agent | |
|---|---|---|---|---|---|---|
| Metal oxide particle No. | Particle species | Particle size | Surface treating agent species | Amount added (mass%) | Surface treating agent species | Amount added (mass%) |
| 1 | tin oxide | 100 nm | KP-574 | 3 | — | |
| 2 | tin oxide | 100 nm | KP-574 | 3 | KBM503 | 3 |
| 3 | tin oxide | 20 nm | KP-578 | 6 | KBM503 | 4 |
| 4 | tin oxide | 20 nm | KP-578 | 6 | — | — |
| 5 | tin oxide | 100 nm | KF-9908 | 3 | KBM503 | 3 |
| 6 | tin oxide | 100 nm | KF-9909 | 3 | KBM503 | 3 |
| 7 | silica | 40 nm | KF-9909 | 4 | KBM503 | 4 |
| 8 | titanium oxide | 30 nm | KF-9909 | 4 | KBM5803 | 4 |
| 9 | tin oxide | 100 nm | — | — | KBM503 | 3 |
| 10 | tin oxide | 100 nm | KF-9901 | 3 | KBM503 | 3 |
| 11 | tin oxide | 100 nm | X-22-4015 | 3 | KBM503 | 3 |
| 12 | alumina | 30 nm | KP-574 | 4 | KBM503 | 4 |
| 13 | alumina | 30 nm | KF-9901 | 4 | KBM503 | 4 |

The surface treating agents in the table are the following compounds.

KP-574: a surface treating agent having a silicone side chain with an acrylic main chain ("KP-574" manufactured by Shin-Etsu Chemical Co., Ltd.)

KP-578: a surface treating agent having a silicone side chain with an acrylic main chain ("KP-578" manufactured by Shin-Etsu Chemical Co., Ltd.)

KF-9908: a surface treating agent having a silicone side chain with a silicone main chain ("KF-9908" manufactured by Shin-Etsu Chemical Co., Ltd.)

KF-9909: a surface treating agent having a silicone side chain with a silicone main chain ("KF-9909" manufactured by Shin-Etsu Chemical Co., Ltd.)

KF-9901: a linear methyl hydrogen silicone oil represented by the following formula ("KF-9901" manufactured by Shin-Etsu Chemical Co., Ltd.)

KF-9901

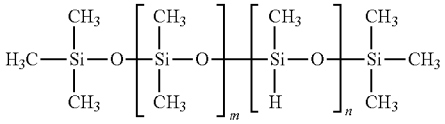

X-22-4015: a linear carbinol-modified silicone oil represented by the following formula ("X-22-4015" manufactured by Shin-Etsu Chemical Co., Ltd.)

X-22-4015

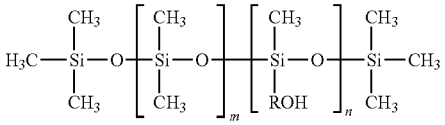

KBM503: methacryloxypropyltrimethoxysilane ("KBM503" manufactured by Shin-Etsu Silicone)
KBM5803: methacryloxyoctyltrimethoxysilane ("KBM5803" manufactured by Shin-Etsu Silicone)

3. Production of Electrophotographic Photoconductor

Example 1: Production of Electrophotographic Photoconductor 1

(1) Preparation of Conductive Support

The surface of a cylindrical aluminum support was cut to prepare a conductive support.

(2) Formation of Intermediate Layer

Polyamide resin (X1010, manufactured by Daicel-Degussa Ltd.): 10 parts by mass Titanium oxide particle (SMT500SAS, manufactured by TAYCA CORPORATION): 11 parts by mass
Ethanol: 200 parts by mass The materials for an intermediate layer were mixed together, and dispersed by using a sand mill, as a disperser, in a batch mode for 10 hours to prepare a coating solution for an intermediate layer. The coating solution was applied onto the surface of the conductive support by using a dip coating method, and dried at 110° C. for 20 minutes to form an intermediate layer with a film thickness of 2 μm on the conductive support.

(3) Formation of Charge Generation Layer

Charge generation material: 24 parts by mass
Polyvinylbutyral resin: 12 parts by mass
Mixed solution: 400 parts by mass The materials for a charge generation layer were mixed together, and dispersed over 0.5 hours by using the circulating ultrasonic homogenizer "RUS-600TCVP" (manufactured by NIHONSEIKI KAISHA, LTD.) at 19.5 kHz and 600 W with a circulation flow rate of 40 L/hour to prepare a coating solution for a charge generation layer. The charge generation material was a mixed crystal of a 1:1 adduct of titanyl phthalocyanine and (2R,3R)-2,3-butanediol, the adduct having a clear peak at 8.3°, 24.7°, 25.1°, and 26.5° in measurement of the Cu-Kα characteristic X-ray diffraction spectrum, and titanyl phthalocyanine with no addition. The polyvinylbutyral resin was "S-LEC BL-1" manufactured by SEKISUI CHEMICAL CO., LTD., where "S-LEC" is a registered trademark possessed by the company. The mixed solution was a mixed solvent of 3-methyl-2-butanone and cyclohexanone, and the mixing ratio was 3-methyl-2-butanone/cyclohexanone=4/1 in a volume ratio.

The coating solution was applied onto the surface of the intermediate layer by using a dip coating method, and dried to form a charge generation layer with a film thickness of 0.3 μm on the intermediate layer.

(4) Formation of Charge Transport Layer

Charge transport material represented by structural formula (A): 60 parts by mass Polycarbonate resin: 100 parts by mass Antioxidant: 4 parts by mass The materials for a charge transport layer were mixed and dissolved together to prepare a coating solution for a charge transport layer. The coating solution was applied onto the surface of the charge generation layer by using a dip coating method, and dried at 120° C. for 70 minutes to form a charge transport layer with a film thickness of 24 μm on the charge generation layer. The polycarbonate resin was "Z300" manufactured by MITSUBISHI GAS CHEMICAL COMPANY, INC., and the antioxidant was "IRGANOX 1010" manufactured by BASF SE. "IRGANOX" is a registered trademark possessed by the company.

(A)

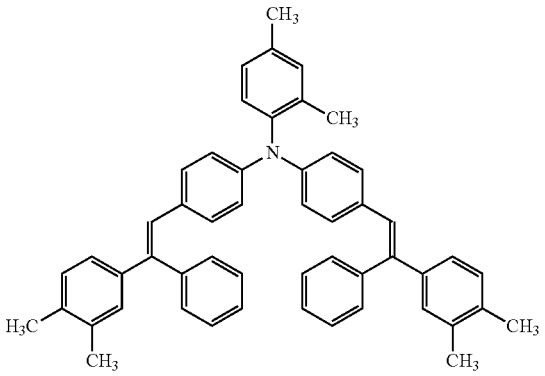

(5) Formation of Surface Layer

Radical polymerizable monomer M2: 60 parts by mass

Radical polymerizable silicone compound-A: 20 parts by mass

Charge transport material represented by structural formula (B): 60 parts by mass Metal oxide fine particle 1: 100 parts by mass Polymerization initiator: 5 parts by mass 2-Butanol: 300 parts by mass Tetrahydrofuran: 30 parts by mass The materials for a surface layer were mixed together, and dissolved/dispersed to prepare a coating solution for a surface layer. The coating solution was applied onto the surface of the charge transport layer by using a circular slide hopper coater. Radical polymerizable monomer M2 was a compound represented by structural formula (C) and the polymerization initiator was IRGACURE 819 (manufactured by BASF Japan, Ltd., "IRGACURE" is a registered trademark possessed by BASF SE).

(B)

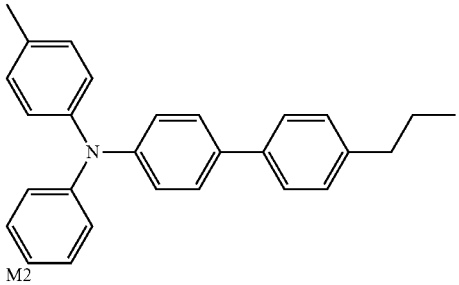

(C)

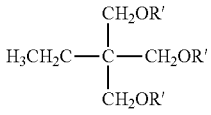

Subsequently, the film of the applied coating solution was irradiated with an ultraviolet ray from a metal halide lamp for 1 minute for curing of the film to form a surface layer with a film thickness of 3.0 μm on the charge transport layer. Thus, electrophotographic photoconductor 1 was produced.

Examples 2 to 18 and Comparative Examples 1 to 4: Production of Electrophotographic Photoconductors 2 to 22

Photoconductors 2 to 22 were produced in the same manner as in Example 1, except that the types of a metal oxide fine particle and lubricant were changed as listed in Table 2.

4. Evaluation of Electrophotographic Photoconductors

Each of electrophotographic photoconductors 1 to 22 was evaluated in the following manner.

Specifically, each of electrophotographic photoconductors 1 to 22 was installed in a full-color copier (product name: "bizhub PRO C6501", manufactured by KONICA MINOLTA, INC., "bizhub" is a registered trademark possessed by the company), and a durability test was carried out in which 100,000 sheets of a test image of two vertical solid stripes (width: 4 cm) were continuously printed out in the A4 crosswise direction in an environment of 10° C. and 15% RH. Subsequently, the abrasion resistance and cleanability of each electrophotographic photoconductor were evaluated.

(1) Abrasion Resistance

Before and after the durability test, 10 portions of homogeneous film thickness (portions within at least 3 cm from each edge were excluded, because the film thickness of each edge of an image bearing member is likely to be heterogeneous) in each electrophotographic photoconductor were randomly selected to measure the thickness by using an eddy current-type film thickness gauge (product name: "EDDY560C", manufactured by HELMUT FISCHER GMBTE, CO.), and the average value was calculated and used as the thickness of the layer on the electrophotographic photoconductor. The difference between the thicknesses of the layer before and after the durability test was used as an amount of abrasion, and the abrasion resistance was evaluated on the basis of the following evaluation criteria.

A: The amount of abrasion was 0.1 μm or less

B: The amount of abrasion was more than 0.1 μm and 0.2 μm or less

C: The amount of abrasion was more than 0.2 μm

If the amount of abrasion was 0.2 μm or less, the electrophotographic photoconductor was determined to be acceptable for practical use.

(2) Cleanability

After the durability test, a halftone image was output on 100 A3 sheets of alkaline paper in an environment of 10° C. and 15% RH so that a black part was positioned in the front of the sheet conveyance direction and a white part was positioned in the back. The white part of the 100th sheet printed out was visually observed for a stain generated by toner slipping, and the cleanability was evaluated on the basis of the following evaluation criteria.

A: No stain was found in the white part

B: Although a minor, streak-like stain was generated in the white part, the cleanability could be deemed sufficient for practical use C: A clear, streak-like stain was generated (insufficient for practical use)

Cases with an evaluation result of "A" or "B" were determined to pass.

Table 2 shows the evaluation results for photoconductors 1 to 22, together with the types of metal oxide fine particles and lubricants used.

TABLE 2

| | Electrophotographic photoconductor No. | Metal oxide particle No. | Lubricant | Abrasion resistance | Cleanability |
|---|---|---|---|---|---|
| Example 1 | 1 | 1 | polymerizable silicone-A | B | A |
| Example 2 | 2 | 2 | polymerizable silicone-A | A | A |
| Example 3 | 3 | 2 | X-22-164C | A | A |
| Example 4 | 4 | 2 | polymerizable PFPE-A | A | A |
| Example 5 | 5 | 2 | polymerizable PFPE-B | A | A |
| Example 6 | 6 | 3 | polymerizable silicone-A | A | A |
| Example 7 | 7 | 4 | polymerizable PFPE-A | B | A |
| Example 8 | 8 | 5 | polymerizable silicone-A | A | A |
| Example 9 | 9 | 5 | X-22-164C | A | A |
| Example 10 | 10 | 5 | MT70 | A | A |
| Example 11 | 11 | 5 | MT70 | A | A |
| Example 12 | 12 | 6 | polymerizable silicone-A | A | A |
| Example 13 | 13 | 6 | MD700/AD1700* | A | A |
| Example 14 | 14 | 7 | polymerizable silicone-A | A | A |
| Example 15 | 15 | 8 | polymerizable silicone-A | A | A |
| Example 16 | 16 | 6 | silicone fine particle | B | A |
| Example 17 | 17 | 6 | — | B | B |
| Example 18 | 18 | 4 | — | B | B |
| Comparative Example 1 | 19 | 9 | — | C | C |
| Comparative Example 2 | 20 | 10 | — | B | C |
| Comparative Example 3 | 21 | 11 | — | B | C |
| Comparative Example 4 | 22 | 9 | polymerizable silicone-A | C | C |

*MD700 and AD1700 were used with a quantitative ratio of 1/1.

As shown in Table 2, electrophotographic photoconductors 1 to 18 in Examples 1 to 18, each including a surface layer containing any one of metal oxide particles 1 to 8 surface-treated with a surface treating agent having a silicone side chain, have good abrasion resistance and cleanability. The result that both abrasion resistance and cleanability were good is presumably because the metal oxide particle surface-treated with a surface treating agent having a silicone side chain is homogeneously dispersed all over the film thickness direction of the surface layer, and hence the metal oxide particle present in the inside appears in the surface portion to exhibit the effect even after a durability test where the surface portion is worn away. Similarly, metal oxide particles 1 to 4, each using a surface treating agent with a silicone side chain branched from an acrylic main chain, and metal oxide particles 5 to 8, each using a surface treating agent with a silicone side chain branched from a silicone main chain, exhibited excellent effect.

In particular, electrophotographic photoconductor 2 in Example 2, including a surface layer containing metal oxide particle 2 surface-treated with both a surface treating agent having a silicone side chain and a reactive surface treating agent, was superior in abrasion resistance to electrophotographic photoconductor 1 in Example 1, including a surface layer consisting of the same composition except that metal oxide particle 1 surface-treated only with a surface treating agent having a silicone side chain was contained. This is presumably because the polymerizable group possessed by the metal oxide particle allowed the metal oxide particle to be present in a state in which the metal oxide particle was chemically bonding to the polymer in the polymerization-cured product forming the surface layer, and the strength of the surface layer was enhanced.

In addition, electrophotographic photoconductors 12, 13, and 16 in Examples 12, 13, and 16, each including a surface layer containing a lubricant, were each superior in cleanability to electrophotographic photoconductor 17 in Example 17, including a surface layer consisting of the same composition except that a lubricant was not contained. Electrophotographic photoconductor 12 in Example 12, including a surface layer containing a polymerizable silicone compound as a lubricant, and electrophotographic photoconductor 13 in Example 13, including a surface layer containing a polymerizable PFPE compound, were each superior in abrasion resistance to electrophotographic photoconductor 16 in Example 16, including a surface layer consisting of the same composition except that a solid lubricant was used as a lubricant.

On the other hand, electrophotographic photoconductor 19 in Comparative Example 1, including a surface layer containing metal oxide particle 9 having a polymerizable group but not surface-treated with a surface treating agent having a silicone side chain, was insufficient for practical use in terms of both abrasion resistance and cleanability. This is presumably because the metal oxide particle without surface treatment with a surface treating agent having a silicone side chain has no silicone chain present on the surface, and hence high friction or high toner adhesion is caused to the photoconductor. Moreover, electrophotographic photoconductor 22 in Comparative Example 4, including a surface layer containing metal oxide particle 9 without surface treatment with a surface treating agent having a silicone side chain and a lubricant, was similarly insufficient for practical use in terms of both abrasion resistance and cleanability. Thus, use of a metal oxide particle without surface treatment with a surface treating agent having a silicone side chain even with a lubricant failed to enhance abrasion resistance and cleanability to a level acceptable for practical use.

Electrophotographic photoconductors 20 and 21 in Comparative Examples 2 and 3, using metal oxide particles 10 and 11, respectively, with a surface treating agent having a silicone main chain, were each insufficient for practical use in terms of cleanability. This is presumably because the metal oxide particle surface-treated with a surface treating agent having a silicone chain as a main chain does not have a high concentration of the silicone chain on the surface, in contrast to a metal oxide particle surface-treated with a surface treating agent having a silicone side chain, and hence high toner adhesion was caused and the cleanability was lower.

5. Production of Intermediate Transfer Belts

Example 19: Production of Intermediate Transfer Belt 1

(1) Preparation of Coating Solution for Formation of Surface Layer

Mixed together and dissolved were 25 parts by volume (as the solid content) of polymerizable silicone-A, 20 parts by volume of metal oxide particle 12, 75 parts by volume of polymerizable monomer M10, and 800 parts by volume of methyl isopropyl ketone. The resulting mixture was charged into a horizontal circulation disperser (DISPERMAT: EKO Instruments), and zirconia beads of ϕ0.3 mm were charged to a packing ratio of 80 vol %, and the resultant was dispersed at 1,000 rpm.

Here, polymerizable monomer M10 used as a raw material was a compound represented by structural formula (D).

Thereafter, the resultant was diluted with methyl isopropyl ketone to a solid concentration of 5 mass %, and 0.25 parts by mass of a photopolymerization initiator (IRGACURE 379: Ciba-Geigy Ltd.) was mixed with 100 parts by mass of the diluted solution obtained. Thus, coating solution 1 for formation of a surface layer was prepared.

M10

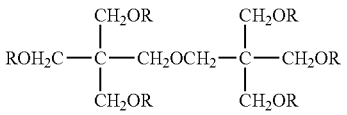

(D)

(2) Production of Intermediate Transfer Belt

A substrate of an endless belt (PI belt) was prepared, and coating solution 1 for formation of a surface layer was applied onto the surface to form a coating film to give a dry film thickness of 2 μm by using a dip coating method with a dip coater under conditions set forth below. Thereafter, the coating film was irradiated with an ultraviolet ray under UV irradiation conditions set forth below to cure the coating film to form a surface layer. Thus, intermediate transfer belt 1 was produced. In the irradiation of the coating film with an ultraviolet ray, the PI belt including the coating film formed on the surface was held by a cylindrical base with the light source fixed, and the cylindrical base was rotated at 60 mm/s.

(Coating Conditions)

Feeding rate of coating solution: 1 L/min

Pulling-up speed: 4.5 mm/min (UV Irradiation Conditions)

Type of light source: high-pressure mercury lamp (H04-L41: manufactured by EYE GRAPHICS CO., LTD.)

Distance from irradiation port to surface of PI belt: 100 mm

Dose of irradiation: 1 J/cm$^2$

Irradiation time (time of rotating cylindrical base): 240 seconds

Comparative Example 5: Production of Intermediate Transfer Belt 2

Intermediate transfer belt 2 was produced in the same manner as in Example 19 except that metal oxide fine particle 12 was replaced with metal oxide particle 13.

6. Evaluation of Intermediate Transfer Belts

The transfer rate, scratch resistance, and filming resistance of each of intermediate transfer belts 1 and 2 were evaluated as properties alternative to actual durability.

(1) Transfer Rate

A bizhub PRO C6500 (a tandem color copier with laser light exposure, reverse development, and an intermediate transfer member) manufactured by Konica Minolta Business Technologies Inc. was customized and used as a full-color image forming apparatus for evaluation of the intermediate transfer belts.

With the amount of light exposure in the evaluation apparatus optimized, intermediate transfer belt 1 or 2 was installed in the evaluation apparatus, and an image in which the coverage rates of yellow (Y), magenta (M), cyan (C), and black (Bk) were each 2.5% was printed out on 1,000,000 sheets of alkaline paper at 20° C. and 50% RH.

The transfer rate of the intermediate transfer belt after the printing was determined in the following manner.

Toner was collected with an aspirator from a region of a given area (three points from 10 mm×50 mm) on an intermediate transfer belt after primary transfer and before secondary transfer to measure the weight of toner before secondary transfer (A).

Next, untransferred toner on the intermediate transfer belt after secondary transfer was collected with BOOKER tape, and pasted on a white sheet, and the white sheet was subjected to colorimetry by using a spectrophotometer (manufactured by Konica Minolta Sensing Inc., CM-2002), and the weight of untransferred toner (B) was determined from the relation between toner weights and colorimetry values obtained in calibration in advance.

Transfer rates (η) were determined by using the following expression.

$$\eta=(1-B/A)\times 100(\%)$$

(2) Scratch Resistance

An image was printed on 1,000,000 sheets in the same manner as in evaluation of transfer rates, and the surface condition of an intermediate transfer belt was observed before and after the printing to count scratches present in a region of 100 mm×100 mm.

(3) Filming Resistance

An image was printed on 1,000,000 sheets in the same manner as in evaluation of transfer rates, and the color difference, ΔE, of an intermediate transfer belt before and after the printing was determined. A spectrophotometer (manufactured by Konica Minolta Sensing Inc., CM-2002) was used to measure the color of an intermediate transfer belt. Then, the difference, ΔE, between color values before and after the printing was calculated. Smaller ΔE indicates good filming resistance, and that the intermediate transfer belt has a low surface free energy property.

Table 3 shows the evaluation results for intermediate transfer belts 1 and 2, together with the types of metal oxide fine particles and lubricants used.

TABLE 3

| | Intermediate transfer belt No. | Metal oxide particle No. | Lubricant | Transfer rate | Scratch count | Filming resistance |
|---|---|---|---|---|---|---|
| Example 19 | 1 | 12 | polymerizable silicone-A | 98% | 0 | 0.5 |
| Comparative Example 5 | 2 | 13 | polymerizable silicone-A | 93% | 6 | 4.2 |

As shown in Table 3, intermediate transfer belt 1 in Example 19, including a surface layer containing metal oxide particle 12 surface-treated with a surface treating agent having a silicone side chain, had a high transfer rate, was not scratched, and had good filming resistance. In contrast to intermediate transfer belt 1, intermediate transfer belt 2 in Comparative Example 5, including a surface layer consisting of the same composition as in Example 19 except that metal oxide particle 13 with a surface treating agent having a silicone main chain was used, had a low transfer rate, was found to be scratched, and had poor filming resistance. These results clearly demonstrate that intermediate transfer belt 2 in Comparative Example 5 is inferior in properties alternative to actual durability to intermediate transfer belt 1 in Example 19.

INDUSTRIAL APPLICABILITY

The present invention can provide an image bearing member for electrophotography, the image bearing member having high mechanical properties including abrasion resistance and scratch resistance, being excellent in toner releasability, and being capable of retaining these features, as an electrophotographic image bearing member for electrophotographic image forming apparatuses. Accordingly, the present invention is expected to provide electrophotographic image forming apparatuses with higher performance and higher durability, and to make them more common.

Although embodiments of the present invention have been described and illustrated in detail, it is clearly understood that the same is by way of illustration and example only and not limitation, the scope of the present invention should be interpreted by terms of the appended claims.

What is claimed is:

1. An image bearing member for electrophotography, comprising a surface layer, wherein the surface layer is composed of a polymerization-cured product of a composition comprising a polymerizable monomer and surface-treated metal oxide particles, the surface-treated metal oxide particles being metal oxide particles surface-treated with a surface treating agent having a silicone side chain, and the surface treating agent having the silicone side chain is a surface treating agent which has a silicone side chain branching from a silicone main chain.

2. The image bearing member according to claim 1, wherein the surface-treated metal oxide particles have a polymerizable group.

3. The image bearing member according to claim 1, wherein the composition further comprises a lubricant.

4. The image bearing member according to claim 3, wherein the lubricant is a polymerizable silicone compound or a polymerizable perfluoropolyether compound.

* * * * *